US007651247B2

(12) United States Patent
Kuan

(10) Patent No.: US 7,651,247 B2
(45) Date of Patent: Jan. 26, 2010

(54) HEAT DISSIPATING DESIGN FOR LAMP

(75) Inventor: Hsin-Ning Kuan, No. 104, Wugong 2nd Rd., Sinjhuang City, Taipei County 242 (TW)

(73) Assignees: Mei-Liang Lo, Taipei County (TW); Hsin-Ning Kuan, Taipei County (TW)

( * ) Notice: Subject to any disclaimer, the term of this patent is extended or adjusted under 35 U.S.C. 154(b) by 476 days.

(21) Appl. No.: 11/612,448

(22) Filed: Dec. 18, 2006

(65) Prior Publication Data

US 2008/0144318 A1 Jun. 19, 2008

(51) Int. Cl.
*F21V 29/00* (2006.01)

(52) U.S. Cl. ..... 362/373; 362/294

(58) Field of Classification Search ..... 362/294, 362/373, 580

See application file for complete search history.

(56) References Cited

U.S. PATENT DOCUMENTS 6,069,561 A * 5/2000 Schopf et al. ..... 340/554
2005/0174780 A1* 8/2005 Park ..... 362/294
2005/0264971 A1* 12/2005 Morino ..... 361/103
2007/0041196 A1* 2/2007 Fujii et al. ..... 362/294
2007/0070629 A1* 3/2007 Hulick et al. ..... 362/294
2007/0230186 A1* 10/2007 Chien ..... 362/294
2008/0055909 A1* 3/2008 Li ..... 362/294

* cited by examiner

*Primary Examiner*—David V Bruce
(74) *Attorney, Agent, or Firm*—Ming Chow; Sinorica, LLC

(57) ABSTRACT

A heat dissipating design for lamp is disclosed. The heat dissipating design of the present invention comprises a main body, which includes a cover. The cover seals up the top portion of the heat dissipating unit, and hence a sealed space is formed. A plurality of light generating units, a light generating units plate, an AC/DC adopter unit and one or more heat conducting pieces are disposed in the sealed space. When heat is generated by the light generating units and the AC/DC adopter unit, heat is transferred to the light generating units plate and the heat conducting pieces and then to the heat dissipating unit and the heat dissipating pieces. Heat is then dissipated into the ambient air. In this way, heat may be dissipated quickly and efficiently.

11 Claims, 9 Drawing Sheets

HEAT DISSIPATING DESIGN FOR LAMP

BACKGROUND OF THE INVENTION

1. Field of the Invention

The invention generally relates to a heat dissipating design for lamp. More particularly, the invention relates to a heat dissipating design (for lamp) that can prevent the damages caused by dusts, water, insects, corrosion and erosion and can prevent the accumulation of dusts on top of the lamp and its heat dissipating unit so that the heat dissipating capacity of a lamp would not be reduced.

2. Description of the Prior Art

Lamps are needed for roads, yards and outdoor places so as to ensure safety at home and in the outdoor and prevent burglaries. Therefore, lamps are indispensable in the modern life. However, lamps of the prior art have the following disadvantages:

1. Traditionally, there have been several types of lamps: sodium lamp, mercury lamp, etc. As of now, LED lamp will become a major type of lamp because it has a high efficiency, a longer service life and a variety of colors and is environmentally friendly. In comparison to these traditional types of lamps, LED lamp requires a higher heat dissipating capacity.

2. In the prior art, the heat dissipating design for an LED lamp is: heat is transferred to a cover and then to a plurality of heat dissipating pieces extending from the cover. Its heat dissipating capacity and intensity of luminance may be reduced and its service life may be shortened by the accumulation of dusts, birds' droppings and nests, etc.

From the above, we can see that the prior art lamps have many disadvantages and need to be improved.

To eliminate the disadvantages of the prior art lamps, the inventor has put in a lot of effort in the subject and has successfully come up with the heat dissipating design (for lamp) of the present invention.

SUMMARY OF THE INVENTION

An object of the present invention is to provide a heat dissipating design (for lamp) that can prevent the damages caused by dusts, water, insects, corrosion and erosion.

Another object of the present invention is to provide a heat dissipating design (for lamp) that can prevent the accumulation of dusts and wherein the heat dissipating pieces extend downwards or sideways so as to enhance the heat dissipating capacity by the ambient cold air rising upwards and to keep other undesirable factors (such as dusts) off.

A third object of the present invention is to provide a heat dissipating design (for lamp) wherein an AC/DC adopter unit is used to supply DC (direct current) to the light generating units so as to be more economical (because no battery is needed).

A fourth object of the present invention is to provide a heat dissipating design (for lamp) wherein a programmable timer and sensor circuit and an overheating protection circuit are disposed in an AC/DC adopter unit so as to turn off or on the light generating units and protect the light generating units from overheating.

The heat dissipating design of the present invention comprises a supporting rod and a main body. The main body includes a heat dissipating unit, a light generating units plate, one or more heat conducting pieces, an AC/DC adopter unit and a cover. The light generating units plate is fixedly fitted to an opening at the central portion or other appropriate location of the heat dissipating unit so that the light generating units point downwards or sideways. The AC/DC adopter unit is fitted on top of the heat conducting pieces. The cover is fitted on top of the heat dissipating unit. The cover seals up the top portion of the heat dissipating unit, and hence a sealed space is formed. The light generating units plate, AC/DC adopter unit and heat conducting pieces are disposed in the sealed space. When heat is generated by the light generating units, heat is transferred to the light generating units plate and the heat conducting pieces and then to the heat dissipating unit and the heat dissipating pieces. Heat is then dissipated into the ambient air. In addition, because the heat dissipating pieces of the heat dissipating unit extend downwards, dusts will not accumulate on them (so that their heat dissipating capacity will not be reduced) so that such lamp may have a longer service life.

These features and advantages of the present invention will be fully understood and appreciated from the following detailed description of the accompanying drawings.

DETAILED DESCRIPTION OF THE PREFERRED EMBODIMENT

Figure 1A:
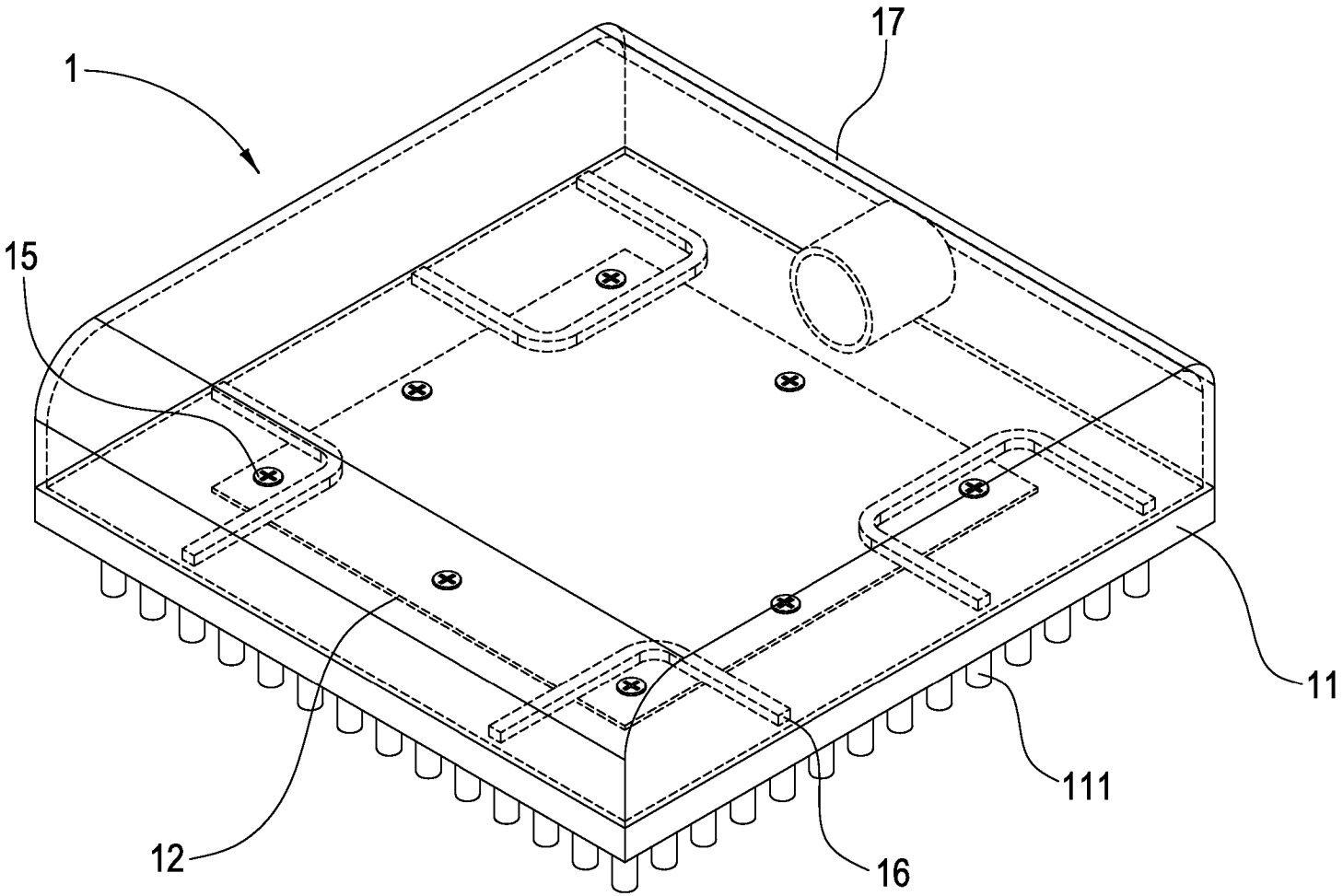
FIGS. 1A and 1B are perspective views showing the first embodiment of the present invention.
Figure 1B:
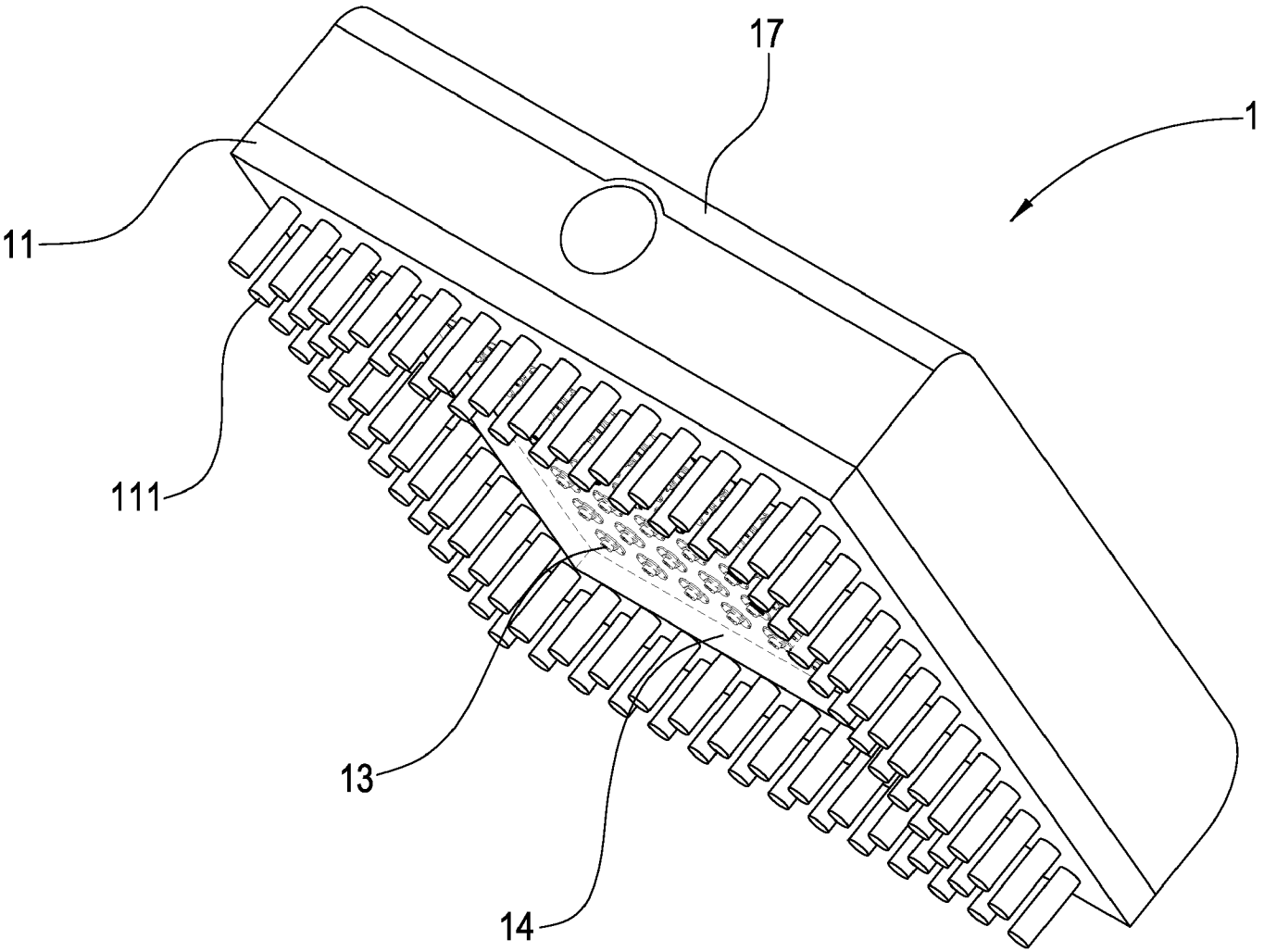
Figure 2:
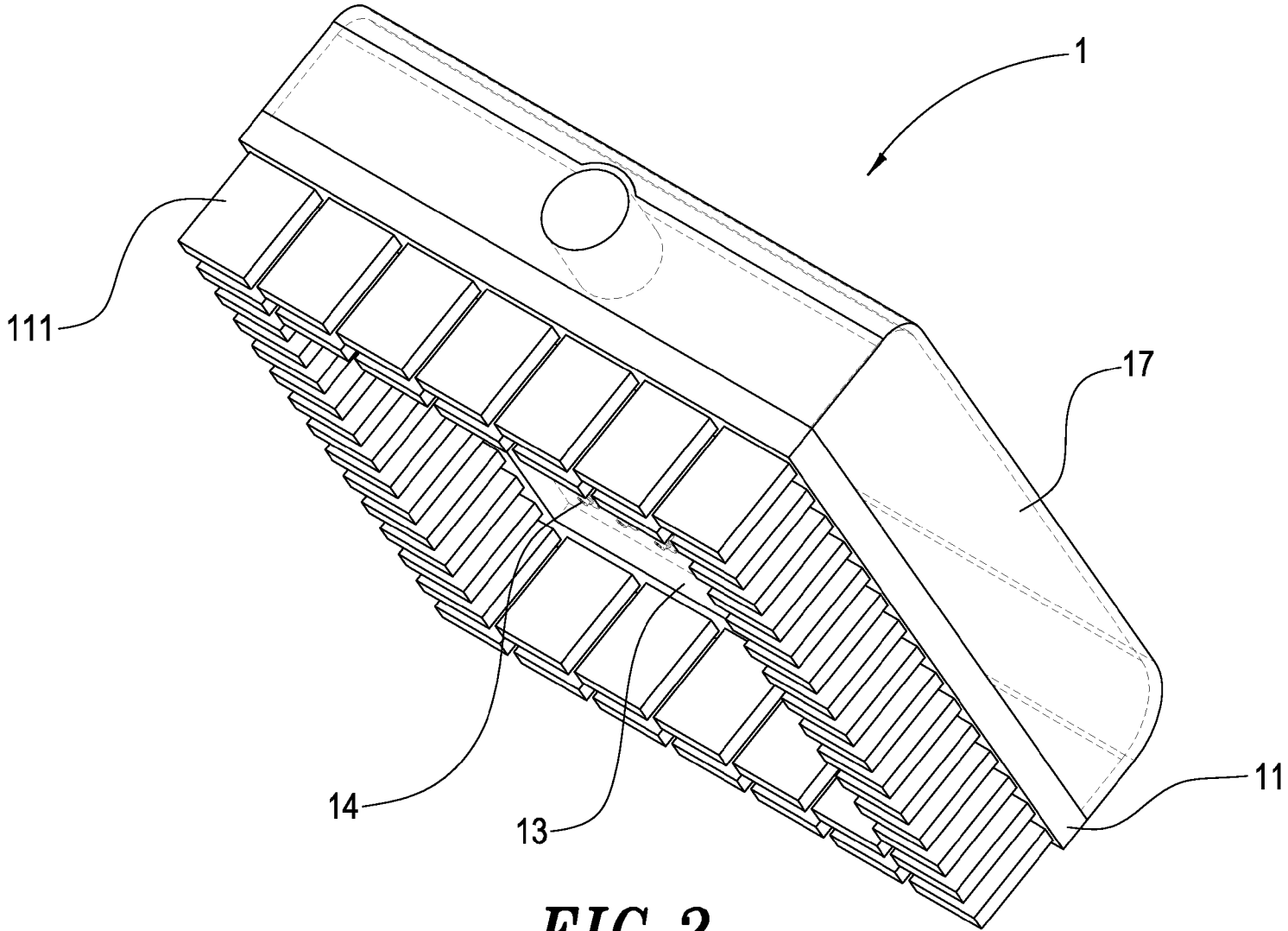
FIG. 2 is a perspective view showing the second embodiment of the present invention.

Please see FIGS. 1A, 1B and 2 for the first embodiment of the present invention. The first embodiment of the heat dissipating design comprises a heat dissipating unit 11, a light generating units plate 12, one or more heat conducting pieces 16 and a cover 17.

An opening (not shown in the drawings) is provided at the central portion or other appropriate location of the heat dissipating unit 11. The top surface may be a planer surface or other type of surface, and a plurality of heat dissipating pieces 111 downwards extend from the bottom side of the heat dissipating unit 11. The heat dissipating pieces 111 may have the shape of a cylindrical rod (as illustrated in FIGS. 1A and 1B) or the shape of a flat rectangular sheet (as illustrated in FIG. 2) or other shape. The heat dissipating pieces 111 point downwards or sideways so that dusts, birds' droppings and nests, etc. will not fall and accumulate on the pieces 111 so that their heat dissipating capacity will not be reduced and their heat dissipating capacity may be enhanced by the ambient cold air rising upwards.

A plurality of light generating units are fitted on the light generating units plate 12. The light generating units plate 12 may be made of aluminum or other types of highly conductive metals. The light generating units 13 may be fitted on the underside or wide walls of plate 12. The light generating units 13 may be LED, OLED or other types of light generating units. Also, a cover 4 is fitted on top of the light generating units 13. The plate 12 is fixedly fitted by fasteners 15 to an opening at the central portion or other appropriate location of the heat dissipating unit 11 so as to seal up the opening and so that the light generating units 13 fitted on the underside of plate 12 may point downwards or sideways.

A portion of each heat conducting piece 16 is in contact with the top surface of the light generating units plate 12, and other portions are in contact with the top surface of the heat dissipating unit 11. The heat conducting pieces 16 may be heat-conducting tubes or heat-conducting flat sheets.

The cover 17 may have the form of a lampshade. The cover 17 is fitted on top of the heat dissipating unit 11. The cover 17 seals up the top portion of the heat dissipating unit 11, and hence the light generating units plate 12 and the heat conducting pieces 16 are sealed from the ambient surroundings so that they will not be affected or damaged by dusts, water, insects, corrosion and erosion.

Figure 3:
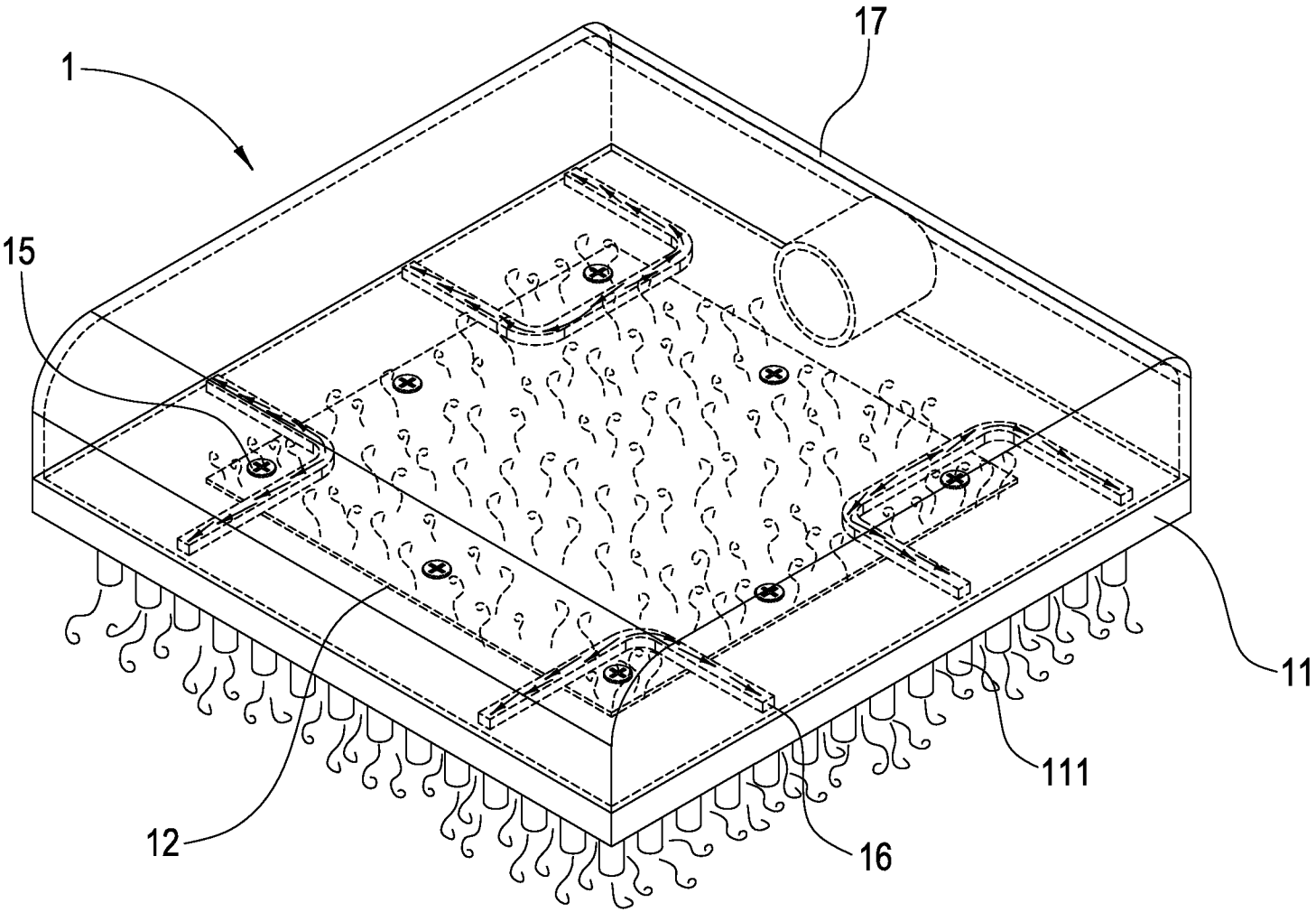
FIG. 3 is a perspective view showing the first embodiment of the present invention in operation.

Now, please see FIG. 3, which illustrates the first embodiment of the present invention in operation. When heat is generated by the light generating units 13, heat is transferred to the light generating units plate 12 and the heat conducting pieces 16 and then to the heat dissipating unit 11 and the heat dissipating pieces 111. Heat is then dissipated into the ambient air. In this way, heat may be dissipated quickly so that the light generating units 13 will not be damaged by overheating.

In addition, because the light generating units plate 12 and the heat conducting pieces 16 are in a sealed space and the heat dissipating pieces 111 point downwards or sideways, no dusts will accumulate on light generating units plate 12, the heat conducting pieces 16 and the heat dissipating pieces 111; therefore, a high efficiency of heat dissipation may be ensured.

Figure 4:
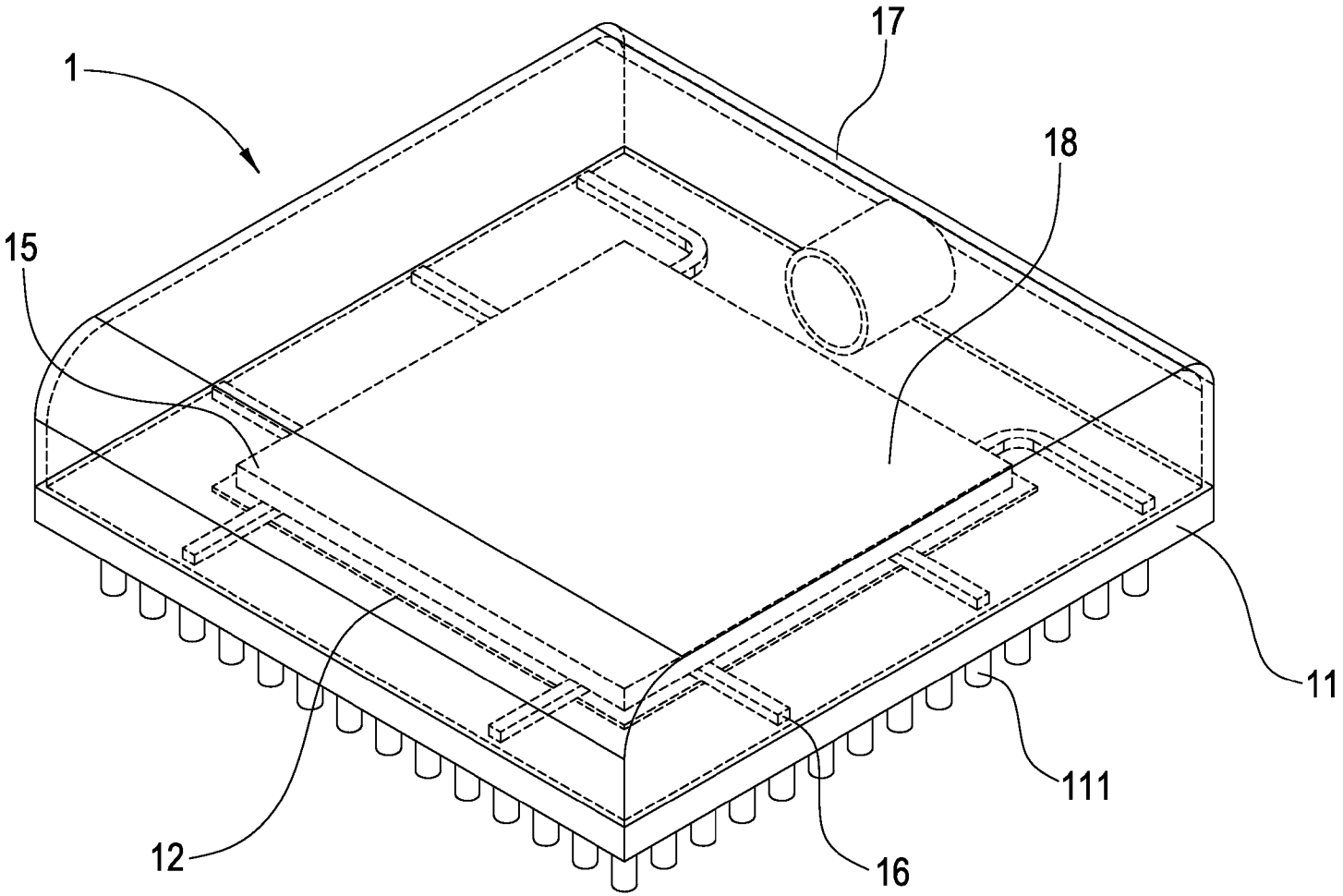
FIG. 4 is a perspective view showing the third embodiment of the present invention.

Now, please see FIG. 4, which illustrates a third embodiment of the present invention. The design of the third embodiment is similar to the first embodiment illustrated in FIGS. 1A and 1B except that an AC/DC adopter unit 18 is used in the third embodiment. The AC/DC adopter unit 18 is fitted on top of and in contact with the heat conducting pieces 16 so that heat generated by the AC/DC adopter unit 18 and a sensor circuit may be transferred to the heat conducting pieces 16 and then to the heat dissipating unit 11 and the heat dissipating pieces 111. Heat is then transferred to the ambient air. In this way, the AC/DC adopter unit 18 may have a longer service life.

The AC/DC adopter unit 18 serves to convert the AC supplied from an electrical outlet to DC; then the DC (direct current) is fed to the light generating units 13. In addition, a programmable timer and sensor circuit and an overheating protection circuit are disposed in the AC/DC adopter unit 18. The programmable timer circuit serves as a timer so as to turn off and turn on the light generating units 13. The overheating protection circuit can detect the temperatures of the light generating units 13; if the light generating units 13 overheat, the overheating protection circuit will turn off the light generating units 13 automatically.

Figure 5:
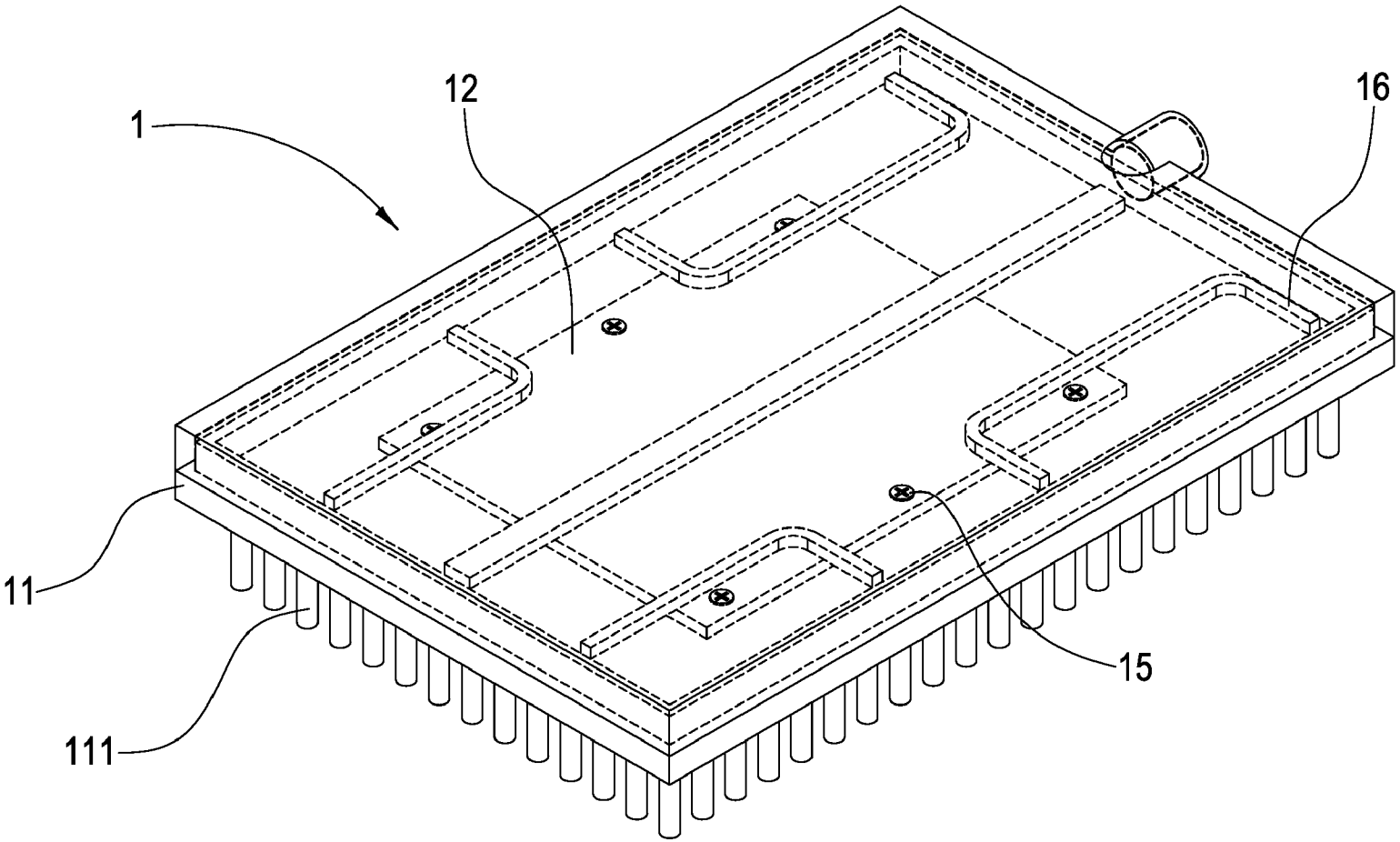
FIG. 5 is a perspective view showing the fourth embodiment of the present invention.

Now, please see FIG. 5, which is a fourth embodiment of the present invention. The design of the fourth embodiment is similar to the first embodiment illustrated in FIGS. 1A and 1B except that the cover 17 has a planer shape so that the cover 17 may be in contact with the top surface of the heat dissipating unit 11 so as to increase the efficiency of heat dissipation.

Figure 6:
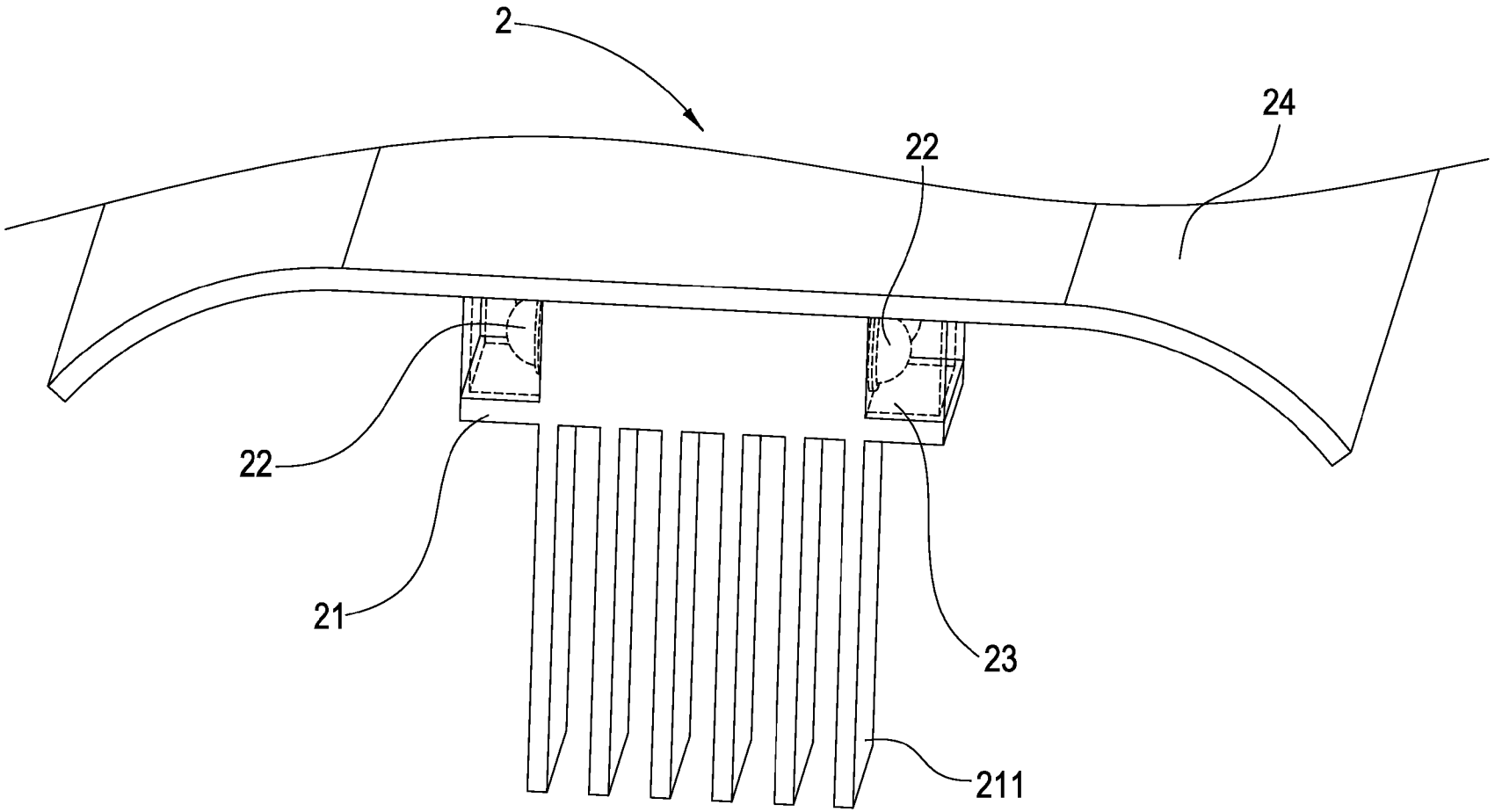
FIG. 6 is a view showing the fifth embodiment of the present invention.

Now, please see FIG. 6, which is a fifth embodiment of the present invention. The lamp comprises a main body 2, which includes a heat dissipating unit 21 and a reflective cover 24.

The heat dissipating unit 21 may have a very long length. A plurality of heat dissipating pieces 211 extend from the bottom side of the heat dissipating unit 21 towards the ground. The heat dissipating pieces 211 may have the shape of a cylindrical rod or the shape of a flat rectangular sheet or other shape. A set of light generating units 22 are fitted on one side or both sides of the heat dissipating unit 21. A cover 23 is fitted onto each set of light generating units 22 so as to seal up the latter.

The reflective cover 24 has an arcuate shape. The width of the reflective cover 24 is larger than that of the heat dissipating unit 21, and the length of the reflective cover 24 may be very long. The reflective cover 24 is fixedly fitted on the top surface of the heat dissipating unit 21 so as to cover the light generating units 22 and so that the light generated by the light generating units 22 may be reflected by the reflective cover 24 so as to propagate downwards so that the light would not dazzle our eyes and the light generating units 22 may become brighter and eye-friendly.

Figure 7:
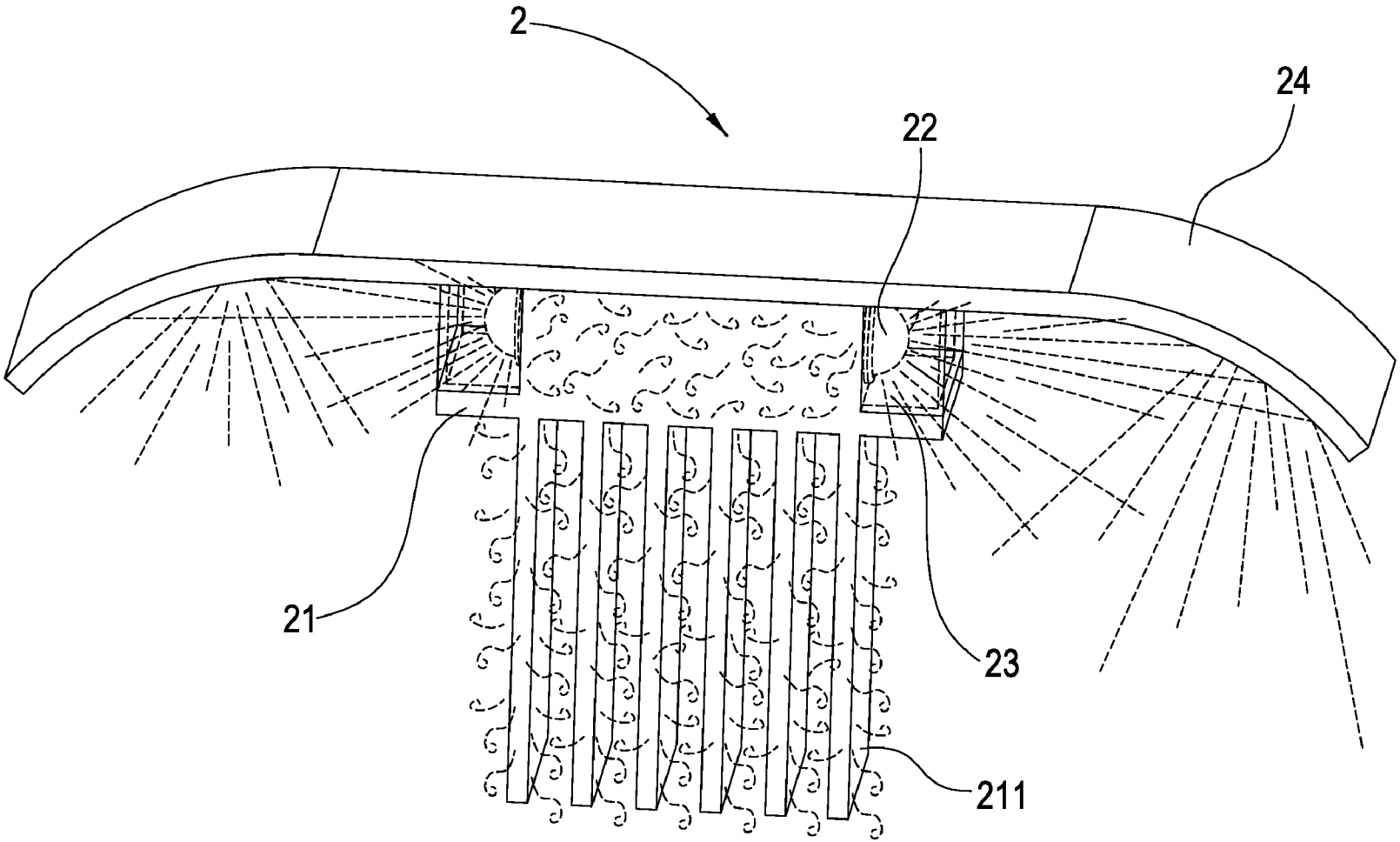
FIG. 7 is a view showing the fifth embodiment of the present invention in operation.

Now, please see FIG. 7, which illustrates the fifth embodiment as shown in FIG. 6 in operation. When heat is generated by the light generating units 22, heat is quickly transferred to the heat dissipating unit 21 and then to the heat dissipating pieces 211. Heat is then dissipated into the ambient air. Because the heat dissipating pieces 211 point downwards, dusts would not fall and accumulate on the heat dissipating pieces 211 so that the heat dissipating pieces 211 may be kept at their highest heat dissipating capacity.

Figure 8:
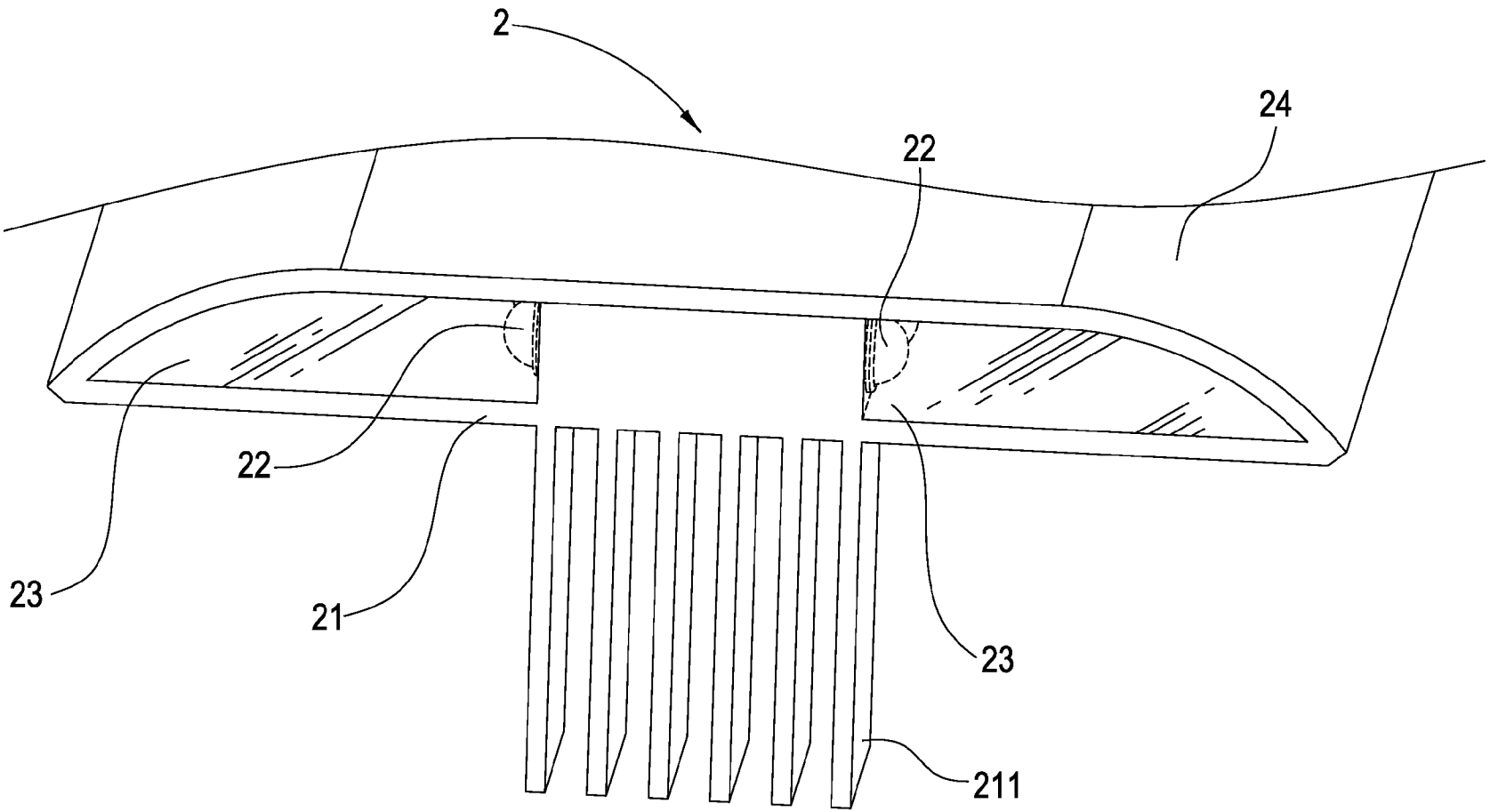
FIG. 8 is a view showing the sixth embodiment of the present invention in operation.

Please see FIG. 8, which is a sixth embodiment of the present invention. The sixth embodiment of the present invention is similar to the fifth embodiment shown in FIG. 6 except that covers 23 are disposed on the reflective cover 24 so as to seal up light generating units 22.

In addition, the reflective cover may have a round shape, a rectangular shape, an oval shape or other shape.

In comparison to the prior art, the heat dissipating design of the present invention has the following four advantages:

1. The heat dissipating design of the present invention can prevent the damages caused by dusts, water, insects, corrosion and erosion.

2. In the heat dissipating design of the present invention, because the heat dissipating pieces of the heat dissipating unit extend downwards towards the ground, the heat dissipating capacity may be enhanced by the ambient cold air rising upwards and other undesirable factors (such as dusts) are kept off; therefore, the heat dissipating pieces may be kept at their highest heat dissipating capacity.

3. In the heat dissipating design of the present invention, an AC/DC adopter unit is used to supply DC (direct current) to the light generating units so as to be more economical (because no battery is needed).

4. In the heat dissipating design of the present invention, a programmable timer and sensor circuit and an overheating protection circuit are disposed in the AC/DC adopter unit. The programmable timer and sensor circuit serves as a timer so as to turn off or on the light generating units, while the overheating protection circuit can protect the light generating units from overheating.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A heat dissipating design for a lamp, comprising:

a heat dissipating unit;

a light generating units plate;

one or more heat conducting pieces;

a cover;

a plurality of heat dissipating pieces of the heat dissipating unit extend downwards;

the light generating units plate is fixedly fitted to an opening at a central portion or other appropriate location of the heat dissipating unit enabling plurality of light generating units point downwards;

a portion of each heat conducting piece is in contact with a top surface of the light generating units plate and other portions of each heat conducting piece are in contact with a top surface of the heat dissipating unit;

the heat dissipating unit and the light generating units plate and the heat conducting pieces are disposed in a completely sealed space created by a cover, enabling heat generated by the light generating units is transferred to the light generating units plate and the heat conducting pieces, and then transferred to the heat dissipating unit and the heat dissipating pieces, and finally transferred into the ambient air; and an AC/DC adaptor unit is fitted on top of and in contact with the heat conducting pieces enabling heat generated by the AC/DC adaptor unit to be transferred to the light generating units plate and the heat conducting pieces, and then to be transferred to the heat dissipating unit and the heat dissipating pieces, and finally to be transferred into the ambient air.

2. The heat dissipating design as in claim 1, wherein the heat dissipating pieces of the heat dissipating unit extend downwards and the light generating units are fitted on the heat dissipating unit enabling heat generated by the light generating units is transferred to the heat dissipating unit and the heat dissipating pieces, and finally transferred into the ambient air.

3. A heat dissipating design for lamp, comprising:

a heat dissipating unit, wherein an opening is provided at the central portion or other appropriate location of the heat dissipating unit and a plurality of heat dissipating pieces extending downward from a bottom surface of the heat dissipating unit;

a light generating units plate, fixedly fitted to the opening and to seal the opening;

a plurality of light generating units being fitted on an underside or wide walls of the light generating units plate enabling the light generating units pointing downwards;

one or more heat conducting pieces, wherein a portion of each heat conducting pieces is in contact with a top surface of the light generating units plate and other portions of each heat conducting pieces are in contact with a top surface of the heat dissipating unit;

a cover being fitted on top of the heat dissipating unit, wherein a completely sealed space is formed above the heat dissipating unit enabling the light generating units plate and the heat conducting pieces being disposed in the completely sealed spacer;

the AC/DC adaptor unit includes a programmable timer and sensor circuit, which serves as a timer to turn off and turn on the light generating units; and the AC/DC adaptor unit includes an overheating protection circuit, which detects temperatures of the light generating units and turns off the light generating units automatically when the temperatures get too high.

4. The heat dissipating design as in claim 3, wherein the heat dissipating pieces are in shape of a cylindrical rod or a shape of a flat rectangular sheet or other shape.

5. The heat dissipating design as in claim 3, wherein the light generating units plate is made of aluminum or other types of highly conductive metals.

6. The heat dissipating design as in claim 3, wherein the light generating units are LED, OLED or other types of light generating units.

7. The heat dissipating design as in claim 3, wherein the cover is in a form of a lampshade.

8. The heat dissipating design as in claim 3, wherein the cover having a planer shape and being in contact with the top surface of the heat dissipating unit so as to increase the efficiency of heat dissipation.

9. The heat dissipating design as in claim 3, wherein the heat conducting pieces are conducting tubes or heat conducting flat sheets or other forms of heat conducting pieces.

10. The heat dissipating design as in claim 3, further comprising an AC/DC adaptor unit, wherein the AC/DC adaptor unit is fitted on top of and in contact with the heat conducting pieces enabling heat generated by the AC/DC adopter unit to be transferred to the heat conducting pieces, and then transferred to the heat dissipating unit and the heat dissipating pieces, and finally transferred to the ambient air.

11. A heat dissipating design for lamp, comprising:

a heat dissipating unit, wherein a plurality of heat dissipating pieces extending downward from a bottom surface of the heat dissipating unit;

a set of light generating units being fitted on one side or both sides of the heat dissipating unit;

a cover is fitted onto each set of light generating units to seal the latter; and a reflective cover, which has a very long length and is fixedly fitted on a top surface of the heat dissipating unit enabling the light generated by the light generating units to be reflected by the reflective cover so as to propagate downwards;

the reflective cover has an arcuate shape and the width of the reflective cover is larger than the width of the heat dissipating unit; and the reflective cover being integrally formed with the heat dissipating unit.

* * * * *